US006307333B1

(12) United States Patent
Sluyterman et al.

(10) Patent No.: US 6,307,333 B1
(45) Date of Patent: Oct. 23, 2001

(54) COLOR DISPLAY DEVICE WITH A DEFLECTION-DEPENDENT DISTANCE BETWEEN OUTER BEAMS

(75) Inventors: Albertus A. S. Sluyterman; Johannes C. A. Van Nes; Daniel Den Engelsen, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/450,232

(22) Filed: Nov. 29, 1999

(30) Foreign Application Priority Data

Dec. 1, 1998 (EP) ..... 98204052

(51) Int. Cl.[7] ..... H01J 29/80

(52) U.S. Cl. ..... 315/368.28; 315/368.26; 313/402; 313/403

(58) Field of Search ..... 315/368.11, 368.24, 315/368.25, 368.26, 368.28, 1, 3, 382.1, 366; 313/402, 403, 408, 409, 3, 6

(56) References Cited

U.S. PATENT DOCUMENTS

| | | | | |
|---|---|---|---|---|
| 2,742,589 | | 4/1956 | Goodrich | 315/13 |
| 4,677,349 | * | 6/1987 | Ruby | 315/368.28 |
| 4,864,195 | | 9/1989 | Masterton | 315/371 |
| 5,027,042 | * | 6/1991 | Sluyterman et al. | 315/368.28 |
| 5,196,768 | * | 3/1993 | Sluyterman | 315/368.28 |
| 5,248,920 | * | 9/1993 | Gioia et al. | 315/368.26 |

FOREIGN PATENT DOCUMENTS

| | | | |
|---|---|---|---|
| 0421523A1 | 4/1991 | (EP) | H01J/29/56 |
| WO9934392 | 7/1999 | (WO) | H01J/29/70 |

* cited by examiner

*Primary Examiner*—Don Wong
*Assistant Examiner*—Wilson Lee

(57) ABSTRACT

A color display device comprises an electron gun, a display screen with a curved inner surface and a flat color selection electrode as well as a deflection means. The distance between the electron beams is dynamically varied, whereby the distance in the deflection space increases as the beams are deflected in at least one direction. The reduction of the distance enables the distance between the color selection electrode and the display screen to be decreased in that direction. As a result, the curvature of the inner surface of the display window is increased, which has a positive effect on the strength and weight of the display window.

19 Claims, 6 Drawing Sheets

COLOR DISPLAY DEVICE WITH A DEFLECTION-DEPENDENT DISTANCE BETWEEN OUTER BEAMS

BACKGROUND OF THE INVENTION

The invention relates to a color display device comprising a color cathode ray tube including an in-line electron gun for generating three electron beams, a color selection electrode and a phosphor screen on an inner surface of a display window and a means for deflecting the electron beams across the color selection electrode.

Such display devices are known.

The aim is to make the outer surface of the display window flatter, so that the image represented by the color display device is perceived by the viewer as being flat. However, an increase of the radius of curvature of the outer surface will lead to an increase of a number of problems. The radius of curvature of the inner surface of the display window and of the color selection electrode should also increase, and, as the color selection electrode becomes flatter, the strength of the color selection electrode decreases and hence the sensitivity to doming, vibrations and droptest increases. An alternative solution to this problem would be to curve the inner surface of the display window more strongly than the outer surface. By virtue thereof, a shadow mask having a relatively small radius of curvature can be used. As a result, doming and vibration problems are reduced, however, other problems occur instead. The thickness of the display window is much smaller in the centre than at the edges. As a result, the weight of the display window increases and the luminosity of the image decreases substantially towards the edges.

SUMMARY OF THE INVENTION

It is an object of the invention to provide a color cathode ray tube of the type mentioned in the opening paragraph, in which the outer surface may be flat or substantially flat, while, at the same time, the above problems are overcome or reduced.

To achieve this, a color display device in accordance with the invention comprises a color selection electrode which is flat in at least one direction, the inner surface of the display window is curved in the at least one direction and the color display device comprises means for dynamically influencing the paths of the electron beams to increase, as a function of the deflection in the at least one direction, the distance between the electron beams at the location of the deflection plane.

By virtue of the presence of the means, the distance between the electron beams (also referred to as "gun pitch") in the plane of deflection can be changed dynamically in such a manner that this distance increases as the deflection increases. By dynamically changing this distance, as a function of the deflection, and hence as a function of the x and/or y-co-ordinate(s), i.e. the position of the electron bean(s) on the screen, the distance between the display window and the color selection electrode can decrease accordingly in the relevant deflection direction. The shape of the inner surface of the display window and the distance between the display window and the color selection electrode determine the shape, in particular the curvature, of the color selection electrode. Since the distance between the electron beams increases as a function of the deflection, the distance between the display window and the color selection electrode decreases and the shape of the color selection electrode can deviate more from the shape of the inner surface of the display window than in known cathode ray tubes, and, in particular, its curvature in the at least one direction can be zero, i.e. the color selection electrode is flat in said direction. Flat color selection electrodes are in fact insensitive, or at least much less sensitive, to doming and vibrations than color selection electrodes having a large (several meters) radius of curvature. This is due to the fact that a flat color selection electrode can be made of much thicker material and/or put under tension.

Preferably the outside surface of the display window is flat in the at least one direction.

'Flat' is to be understood to mean 'having an infinite radius of curvature or at least a radius of curvature which is much (several times) larger than the radius of curvature of the inner surface', in other words 'flat' is to be understood to mean 'flat' in the practical meaning, not of course in a mathematical meaning, since no real surface or element is 'truly flat' in the mathematical sense of the word. The flat outer surface offers the advantage that the appearance of the display device, especially when not in function is 'flat'.

Preferably the means comprise a first and a second means which are at some distance from each other. Using two means enables a better control of the change in pitch, and it enables the pitch at the deflection plane to be influenced in such a manner that the convergence of the electron beams is better controllable.

Preferably the inner surface of the display window is curved in two directions, and the display device comprises further means for dynamically influencing the paths of the electron beams so as to increase the distance between the electron beams at the location of the deflection plane in a second direction. Preferably the further means comprise third and fourth means at some distance from each other. Said third and fourth means may be separate from the first and second means, but are preferably integrated in or equivalent to the first and second means.

The advantage of embodiments in which the inner surface is curved in two directions is that the thickness of the display window can be appreciably reduced compared to embodiments in which the inner surface is curved in only one direction. If the inner surface has an infinite radius of curvature in one direction (i.e. it is flat), the display window is relatively weak in that direction, which necessitates a relatively large thickness of the display window, and thus a large weight of the display window. By shaping the inner surface of the display window so that it is curved in two directions, the weight of the display window can be reduced.

Preferably the radius of curvature along the at least one and/or (preferably and) the second direction of the inner surface of the display window ranges between 8 and 16 times the diameter of the display window. For such radii of curvature the strength of the display window is sufficient, and, at normal viewing distances for TVT (television display devices), the display window conveys the impression that the image shown on the display device has an infinite, or nearly infinite, radius of curvature, i.e. it is 'flat'. Larger radii of curvature require an increased thickness of the display window, and thus an increase in the weight and cost of the display device, and result in an image which, to the viewer, seems inwardly curved, while smaller radii of curvature result in an image which, to the viewer, seems outwardly curved.

Preferably, the first means and/or third means are integrated in the electron gun, that is, the first means and/or third means comprise one or more components of the electron gun.

In comparison with a first and/or third means which is/are separate from the electron gun, this has the advantage that fewer components are necessary and that the distance between the first and the second means is increased, thus enabling an increase of the possible variation in distance between the electron beams and hence of the variation in distance between the color selection electrode and the display screen and, consequently, a larger change in curvature of the color selection electrode.

Preferably, the first means and/or third means comprise one or more components of the prefocusing portion of the electron gun. As a result, the distance between the first and/or third means and the second and/or fourth means is increased compared to embodiments in which the first means and/or third means are situated at the location of, for example, the main lens portion, thus enabling an increase of the possible variation in distance between the electron beams and hence of the variation in distance between the color selection electrode and the display screen.

Preferably, the second means and/or fourth means are integrated in the deflection means, that is, said means comprise one or more components of the deflection means.

This has the advantage, compared to separate second and/or fourth means, that fewer components are necessary and that the distance between the first and/or third means and the second and/or fourth means is increased, thus enabling an increase of the possible variation in distance between the electron beams and hence of the variation in distance between the color selection electrode and the display screen.

These and other objects of the invention will be apparent from and elucidated with reference to the embodiments described hereinafter.

BRIEF DESCRIPTION OF THE SEVERAL VIEWS OF THE DRAWING

The Figures are not drawn to scale. In the Figures, like reference numerals generally refer to like parts.

DETAILED DESCRIPTION OF THE INVENTION

Figure 1:
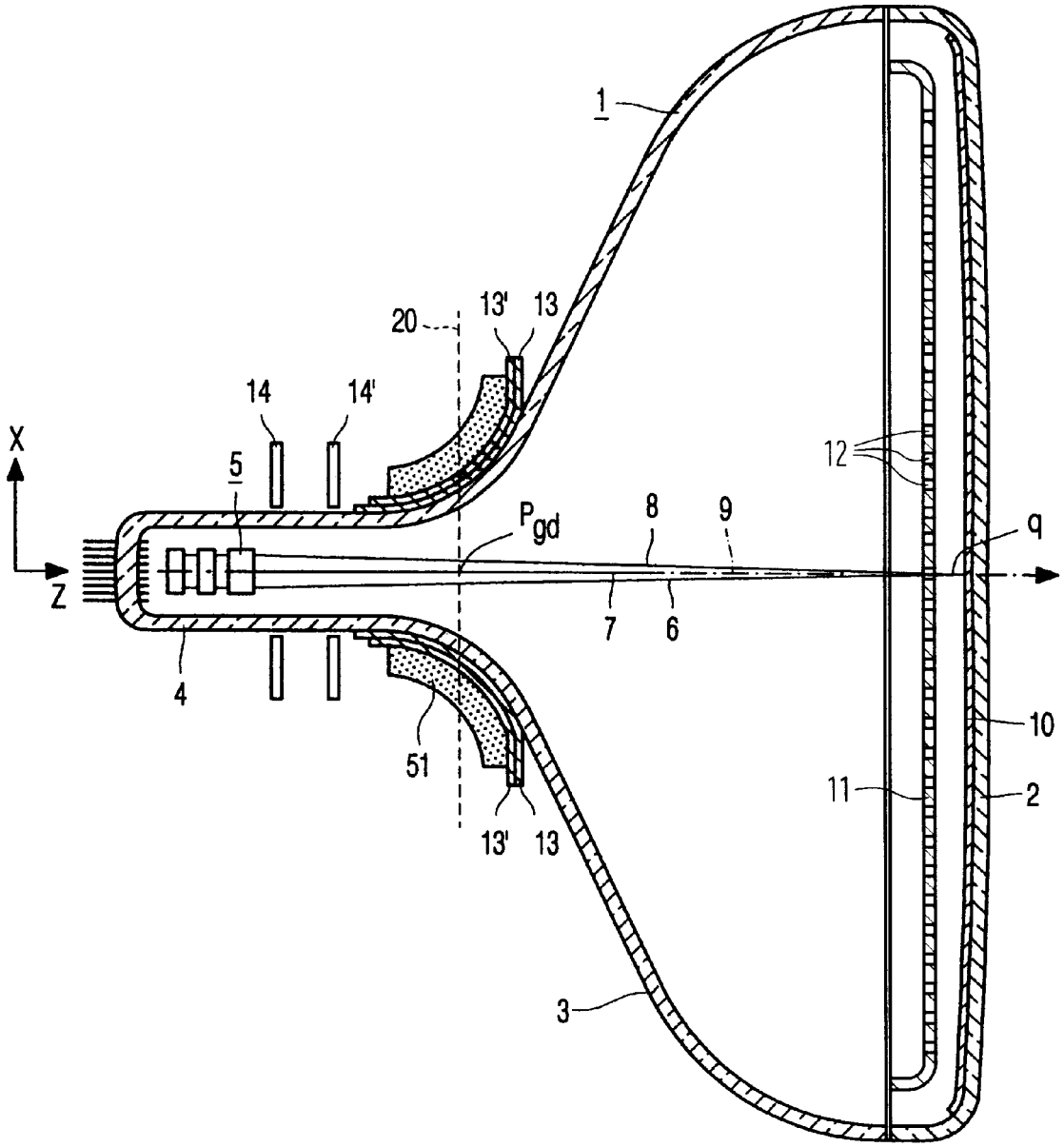
FIG. 1 is a sectional view of a display device, in which the invention is schematically shown.

The display device comprises a cathode ray tube, in this example a color display tube, having an evacuated envelope 1 which includes a display window 2, a cone portion 3 and a neck 4. In the neck 4, there is arranged an electron gun 5 for generating three electron beams 6, 7 and 8 which extend in one plane, the in-line plane, which in this case is the plane of the drawing. In the undeflected state, the central electron beam 7 substantially coincides with the tube axis 9. The inner surface of the display window is provided with a display screen 10. Said display screen 10 comprises a large number of phosphor elements luminescing in red, green and blue. On their way to the display screen, the electron beams are deflected across the display screen 10 by means of an electromagnetic deflection unit 51 and pass through a flat, preferably stretched (i.e. under tension) color selection electrode 11 which is arranged in front of the display window 2 and which comprises a thin plate having apertures 12. The color selection electrode is flat in at least one direction and could be curved in another direction. The three electron beams 6, 7 and 8 pass through the apertures 12 of the color selection electrode at a small angle relative to each other and hence each electron beam impinges only on phosphor elements of one color. The deflection unit 51 comprises, in addition to a coil holder 13, coils 13' for deflecting the electron beams in two mutually perpendicular directions. The display device further includes means for generating voltages which, during operation, are fed to components of the electron gun via feedthroughs. The deflection plane 20 is schematically indicated as well as the distance $P_{gd}$ between the electron beams 6 and 8 in this plane, and the distance q between the color selection electrode and the display screen.

Figure 2A:
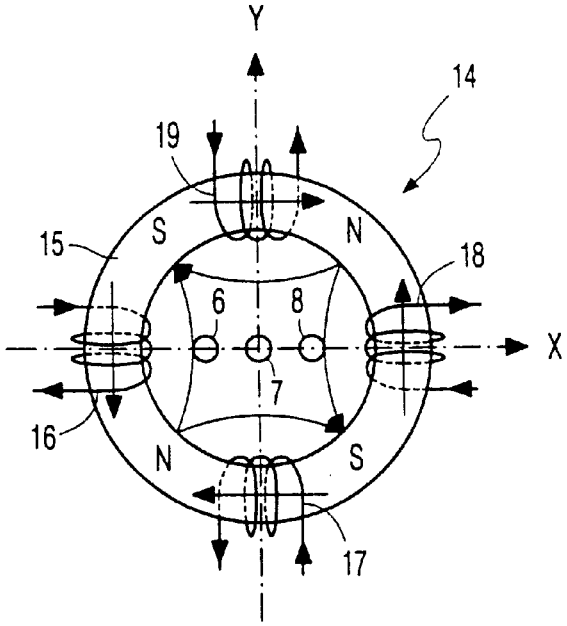
FIGS. 2A, 2B schematically show a number of quadrupole elements.
Figure 2B:
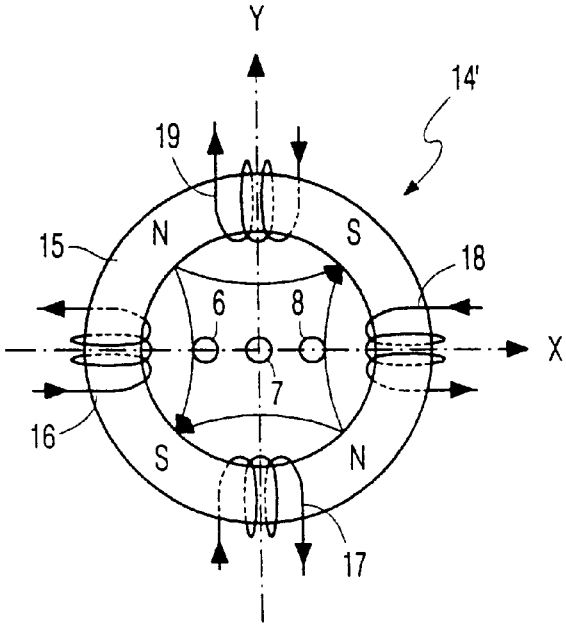
Figure 6:
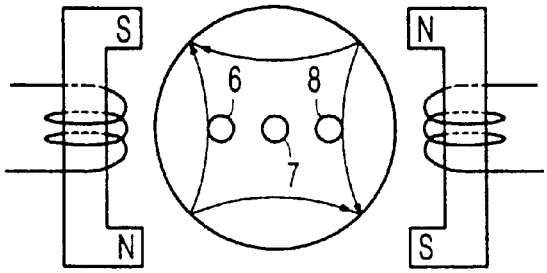
FIGS. 6 and 7 show alternative embodiments of quadrupole elements.
Figure 7:
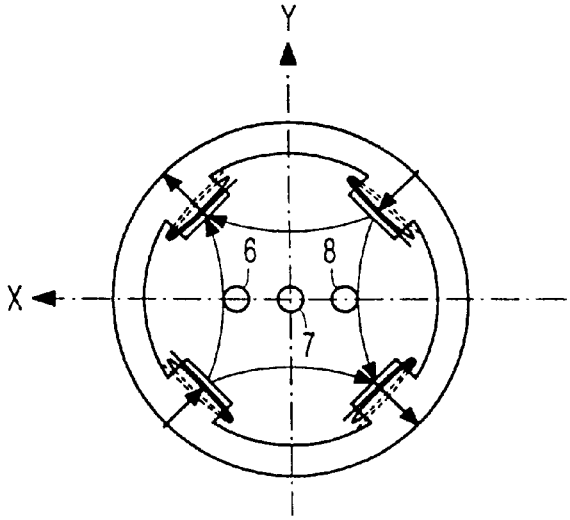

The color display device comprises two means 14, 14', a means 14 being used, in operation, to dynamically bend, i.e. as a function of the deflection in a direction, the outermost electron beams away from each other, and a further means 14' being used to dynamically bend the outermost electron beams in opposite directions. FIGS. 2A and 2B show examples of such means. In this case, means 14 (FIG. 2A) comprises a ring core of a magnetizable material around which four coils 16, 17, 18 and 19 are wound in such a manner that, upon excitation (using, for example, a current which is proportional to the square of the line deflection current), a 45E 4-pole field is generated. A 45E 4-pole field can alternatively be generated by means of two wound C-cores, as shown in FIG. 6, or by means of a stator construction as shown in FIG. 7. The construction of means 14' (FIG. 2B) is comparable to that of means 14. However, the coils are wound in such a manner, and the direction in which, in operation, current passes through the coils is such that a 45E 4-pole field is generated having an orientation which is opposite to that of the 45E field shown in FIG. 2A. The combined action of the means 14 and 14' causes a change in the distance $P_{gd}$. The convergence of the beams is, in a first order approximation, not effected by the combined action of means 14 and 14'. The distance $P_{gd}$ can thus be made larger or smaller. In the display device according to the invention, the distance p is increased as a function of the deflection. Within the concept of the invention, the combined effect of the means 14 and 14' on the distance $P_{gd}$ may be, for undeflected electron beams, an increase or a decrease of the distance p. The invention relates to the change of the distance $P_{gd}$ as a function of deflection. Preferably the combined action of means 14 and 14' causes, for undeflected beams, a decrease of the distance p in comparison to a situation where the means are not present (or inactive), the decrease being such that, as the distance increases as a function of deflection, the total effect of the first and second means becomes zero between ⅓ and ⅔ of the total deflection. Such an embodiment is preferred because the gun is generally made in such a way that the image is as good as possible for a certain gun pitch, deviations from said gun pitch introducing small errors. Such errors are minimised by ensuring that the influence of the means is substantially zero.

FIG. 1 schematically shows the invention. The three electron beams 6, 7 and 8 are separated from each other in the plane of deflection (a plane 20 which is situated approximately in the centre of the deflection unit 11) by a distance $P_{gd}$. The distance q between the color selection electrode 12 and the display screen 10 is inversely proportional to the distance $P_{gd}$. In a formula, this can be expressed as follows: $q=CP_{gd}^{-1}$, where C is a constant. So by increasing the distance $P_{gd}$ as a function of deflection, the distance q can be decreased.

The color display device in accordance with the embodiment of the invention shown in FIG. 1 comprises two means (14, 14'), which are positioned at some distance from each other, and which are used to vary the distance $P_{gd}$, as a function of the deflection, in such a manner that this distance $P_{gd}$ increases as a function of the deflection in at least one direction.

Preferably, the means can suitably be used to dynamically vary the distance $P_{gd}$ between the electron beams in at least the y-direction. The advantage resulting from a flatter construction of the display window is largest in the y-direction.

Figure 3:
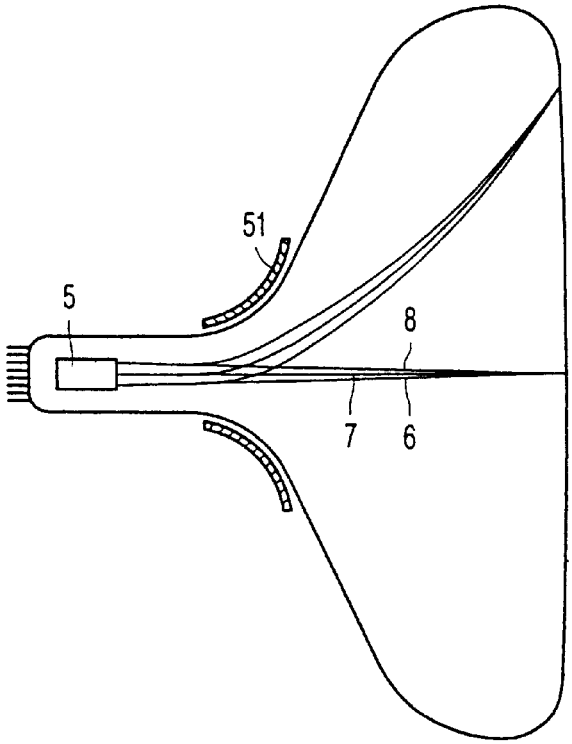
FIGS. 3 and 4 show, by means of schematic, sectional views of color display devices, a number of recognitions on which the invention is based.
Figure 4:
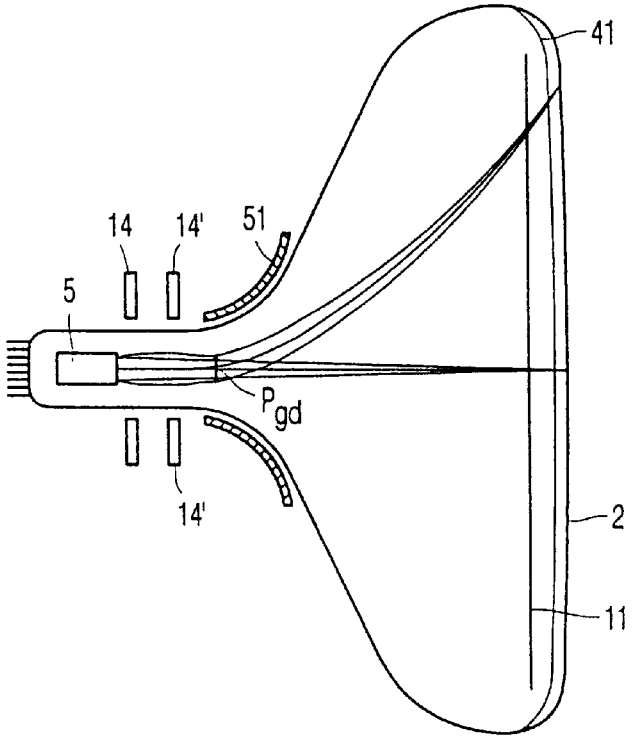

This effect is illustrated in FIGS. 3 and 4. FIG. 3 shows a color display device without the means 14, 14'. The distance between the electron beams at the location of the deflection unit 51 does not change as a function of the deflection. In FIG. 4, the means 14, 14' do change this distance, i.e. the means 14 bends the electron beams away from each other, and the means 14' bends the electron beams in opposite directions. As a result, the distance between the electron beams is larger for deflected electron beams than for undeflected electron beams. Since the distance $P_{gd}$ is larger, the distance q may decrease. The shadow mask 11 is flat, therefore the decrease of the distance q leads to an increase of the curvature of the inner surface 41 of the display window 2. This has a positive effect on the strength of the display window.

Figure 5:
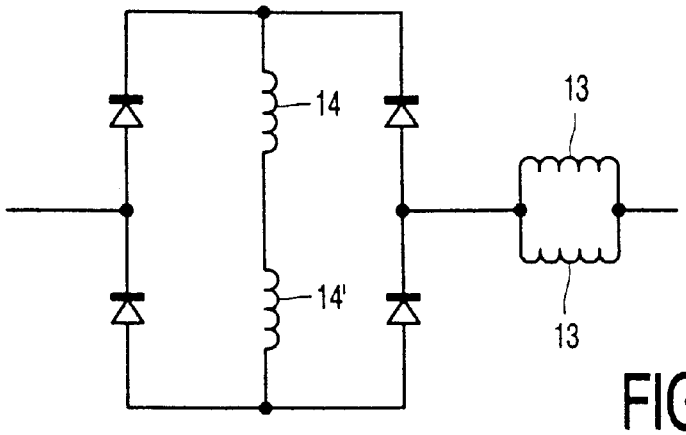
FIG. 5 shows an example of interconnecting quadrupole elements in a circuit.

FIG. 5 shows, with reference to an example, how the means 14 and 14' can be incorporated in a circuit having line deflection coils 13.

FIGS. 6 and 7 show two alternative embodiments of means for generating a quadrupole. In FIG. 6, two U-shaped magnetic cores are used to generate a quadrupole magnetic field. In FIG. 7, a ring-shaped core with four inward protrusions around which coils are wound is used to generate a quadrupole magnetic field.

FIGS. 1 through 7 show embodiments in which the color display device comprises two means 14, 14' which are situated between the gun 5 and the deflection unit 51.

In accordance with an alternative embodiment, the means 14' is integrated in the deflection unit either by winding a separate coil onto the deflection unit to generate a dynamic electromagnetic 4-pole field or by modifying the windings of an existing deflection coil in such a manner that the deflection coils generate a dynamic electromagnetic 4-pole field.

In accordance with another alternative embodiment, the means 14 is integrated in the electron gun 5. For instance, by applying dynamic voltage differences between two or more apertures in subsequent electrodes, the centre line of the apertures in these electrodes being displaced relative to each other, an electric field can be applied which comprises a component at right angles to the direction of movement of the electron beams (in the x-direction), so that the beams are moved towards each other. Similar effects can be obtained (see FIG. 12 for instance) by suitable magnetic fields. The integration of the means 14 in the electron gun has the advantage that the distance between the first means 14 and the second means 14' is increased, thus enabling a greater dynamic change in the distance $P_{gd}$ and hence a greater change in the distance q from the centre to the edge. The means may be integrated in a main lens portion or they may be right in front of a main lens portion. In an example, the distance between the outermost apertures in the first main lens electrode is smaller than in the second main lens electrode (also referred to as anode). Between the main lens electrodes a voltage is applied which comprises a dynamic component. By virtue thereof, the electron beams can be made to move towards each other or away from each other in the main lens; the dynamic component in the voltage between the main lens electrodes causes a dynamic change of the convergence. A similar effect can be brought about between sub-electrodes of the main lens portion of the electron gun. In these embodiments, the means 14' is a separate quadrupole-generating element as shown in FIGS. 1 through 7 or, preferably, it is integrated in the deflection unit to maximise the distance between the means 14 and 14'. Preferably, the means 14 is integrated in the prefocusing portion of the electron gun, for example by displacing outermost apertures in the G2 and G3 electrodes relatively to each other and applying a dynamic component-containing potential difference between the electrodes. As a result of the relative displacement of the apertures in the electrodes, the electric field generated, in operation, between the electrodes comprises a component transverse to the direction of propagation of the outermost electrodes, so that the convergence of the electron beams is influenced. The dynamic component in the voltage applied between the electrodes brings about a dynamic adaptation of the convergence, so that in the prefocusing part of the gun in accordance with the invention, the beams are made to move towards each other as a function of the deflection. Such a means 14 can be combined with a means 14', as shown in FIGS. 1 through 7, or with a means 14' integrated in the deflection unit 51. This has the advantage that there is a large distance between the means 14 and 14'. As a result of the fact that the convergence of the beams in the prefocusing portion is changed dynamically, the position of the outermost electron beams in the main lens is also subject to a dynamic variation. This change will also cause a change of the direction of the electron beams, which generally results in the electron beams moving in opposite directions. The second means 14' may be constituted by the main lens itself, to which a dynamic voltage may or may not be applied.

The invention can be briefly summarised as follows: a color display device comprises an electron gun, a display screen and a flat color selection electrode as well as a deflection means. The distance between the electron beams is dynamically varied, i.e. the distance between the electron beams in the deflection plane increases as the beams are deflected in at least one direction. The increase of the distance enables the distance between the flat color selection electrode and the display screen to be decreased in that direction. As a result, the curvature of the inner surface of the display window is increased, which has a positive effect on the strength and weight of the display window.

It will be obvious that within the scope of the invention many variations are possible to those skilled in the art.

Preferably, the change of the distance q as a result of the dynamic change of the distance $P_{gd}$ is more than 1.5 mm, measured from the centre to the upper side or lower side (that is in the y-direction).

Figure 8:
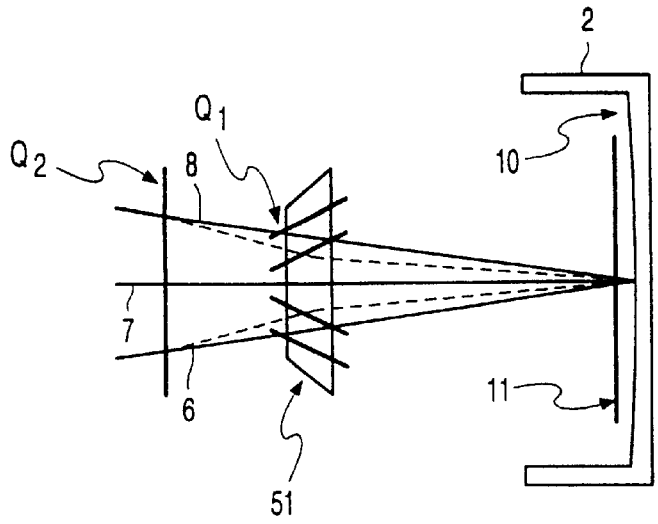
FIGS. 8 and 9 illustrate some aspects of the invention.

For a better understanding of the invention, some principal aspects of the invention are described below and illustrated by FIGS. 8 and 9.

Real flat CRTs have recently come onto the market. When the display window (sometimes also called 'the panel')

becomes flatter, the shadow mask also has to be made flatter. As a result, the mask becomes more sensitive to doming (causing discoloration of the image) and drop test (causing buckling of the mask). This problem can be overcome by keeping the shadow mask under tension, i.e. flat. As a result, however, the radius of curvature of the inner surface of the display window also increases. If the inner surface of the display window has a large radius of curvature and the outer surface is flat, then the display window used must be thick in order to obtain a panel that is strong enough. The thickness of the display window affects the speed of thermal processing of the CRT as well as the weight of the CRT.

A color display device in accordance with the invention enables a fairly small tube weight, a small thickness of the display window and a relative small glass wedge, e.g. only 10 mm, to be obtained. In FIG. 8, the principle of the invention is schematically shown: by means of two quadrupoles (Q1 and Q2), the mask-screen distance in the vertical direction can be modulated. In this way a larger curvature of the inner surface of the display window 2 can be obtained for a flat color selection electrode 11. The invention can be applied in particular jointly with the double mussel coil technology. In the example shown in FIG. 8, the second quadrupole Q2 is integrated into the frame deflection unit. It can be integrated into the frame coil or wound as a separate coil in a toroidal form around the core of the deflection unit.

Figure 9:
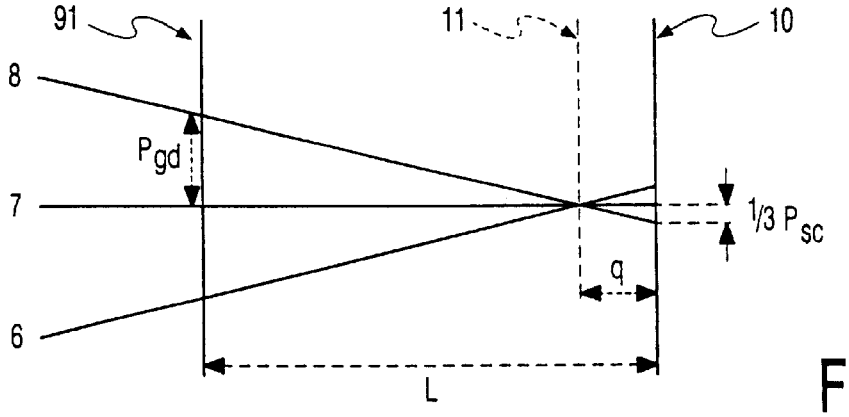

FIG. 9 shows the relation between the gun pitch $P_{gd}$ (i.e. the distance between the central and outer beams at the deflection plane 91 of the deflection unit), the screen pitch $P_{sc}$ (i.e. the distance between the central and outer beams at the screen 10), the distance L between the deflection plane and the screen, and the distance q between the shadow mask and the screen. The three beams 6, 7, 8 leaving the gun are made to converge on the screen 10. FIG. 9 shows that for a given screen pitch $P_{sc}$ and a given distance L, the distance q increases when the gun pitch $P_{gd}$, decreases. Mathematically this relation is given by:

$$q=(P_{sc}*L)/(3*P_{gd}+P_{sc}).$$

So, in accordance with the invention, by varying the gun pitch as a function of deflection, the mask-to-screen distance q can be varied for each point on the screen and additional curvature of the inside surface of the display window is obtained.

Figure 10:
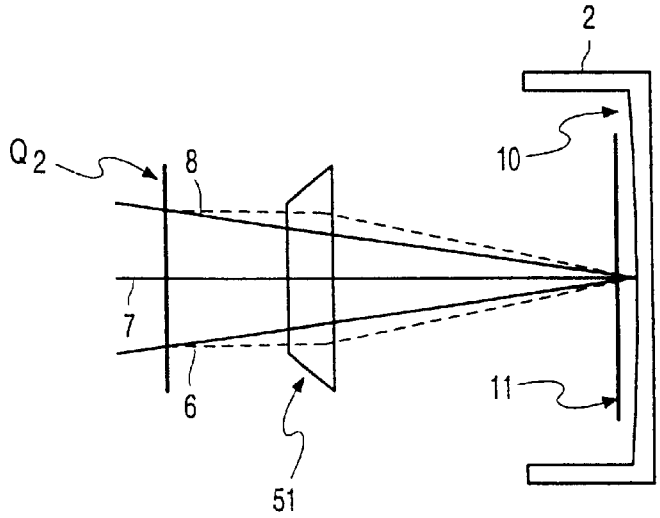
FIGS. 10, 11 and 12 illustrate embodiments of the invention.

FIG. 10 shows an embodiment of the invention in which a first means is provided for generating a quadrupole magnetic field, and in which the deflection unit generates a non-self-convergent deflection field. For small angles of deflection, the quadrupole magnetic field has no influence on the distance between the electron beams. As the angle of deflection increases, the quadrupole field causes the distance between the electron beams to increase. The deflection field is, however, non-self convergent, in other words, it changes the convergence of the electron beams as the deflection angle increases. The non-self convergence of the field compensates for the effect of the quadrupole Q2 in so far as the convergence of the beams is concerned. However, at the plane of deflection, the distance between the beams has increased, which has the effects described above. The advantage of this embodiment is that only one quadrupole field is needed.

Figure 11:
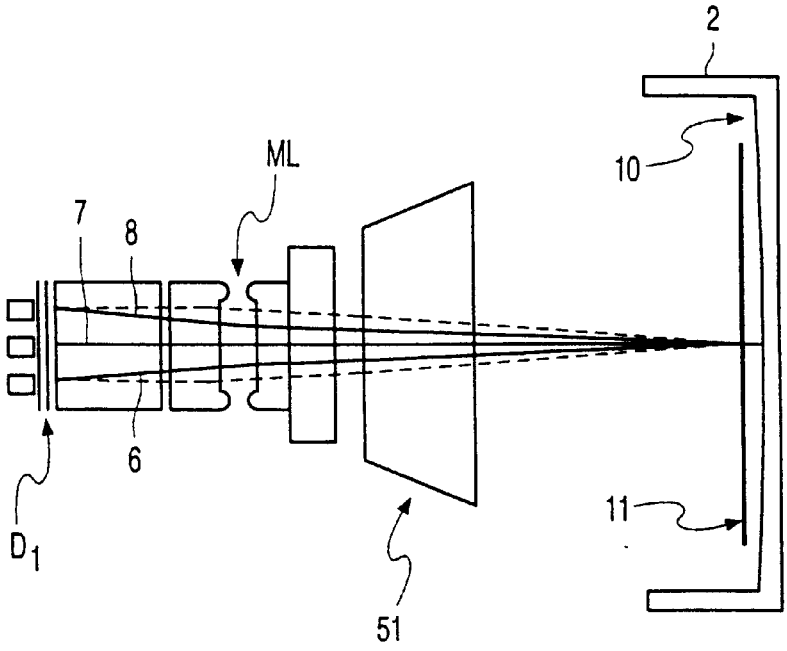

FIG. 11 shows yet another embodiment of a color display device in accordance with the invention. In this embodiment a dynamic field $D_1$ is generated between grids G2 and G3. This field increases, as a function of the deflection, the distance between the outer electron beams in the main lens (ML). Due to this increase, the outer electron beams enter the main lens eccentrically, i.e. at a position closer to the edge of the main lens electrodes than normally. As a result, a force is generated which acts on the outer electron beams, thereby causing them to move towards each other. The advantage of this embodiment is that the main lens itself does not need to be supplied with dynamic voltages, but that the dynamic effect occurs due to the shift in position of the other beams as they enter the main lens.

Figure 12:
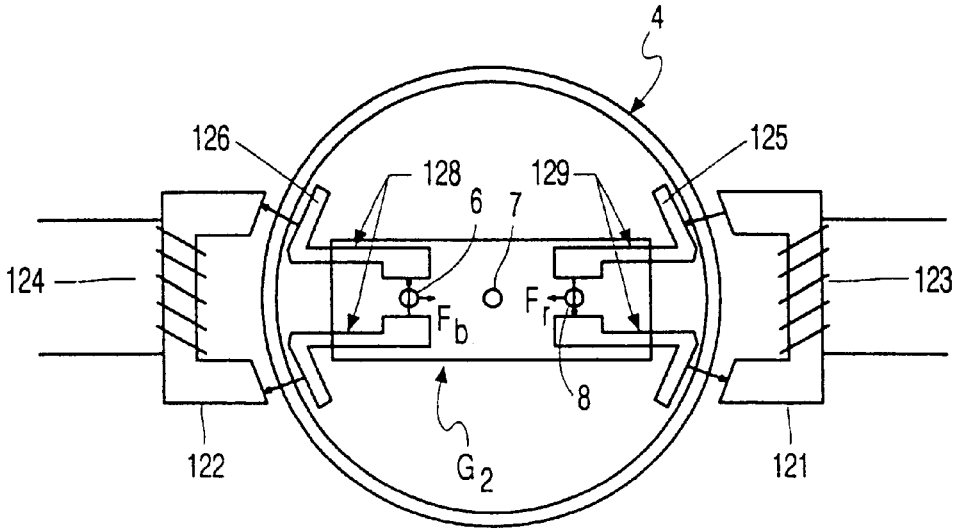

Field $D_1$ may be generated electrically, for instance, by arranging the apertures of G2 and G3 so as to be offset with respect to each other and applying a dynamic voltage difference between the electrodes G2 and G3. FIG. 12 shows an embodiment in which field D1 is generated by magnetic means. In this embodiment, a dynamic magnetic field is generated near the grid G2. Two U-shaped magnetic cores 121, 122 are provided with coils 123, 124 for generating dynamic magnetic fields. Inside the neck 4 of the envelope and near the grid G2, soft magnetic elements 125, 126 are provided. These soft magnetic elements guide the magnetic field to a position near the outer electron beams. The magnetic field formed between the parts 128, 129 generates Forces $F_r$ and $F_b$ on the outer electron beams 6 and 8, thereby changing the distance between the electron beams in the plane of deflection. The elements 128 and 129 are embodied so as to generate locally, near the electron beams, substantially homogeneous magnetic dipole fields. The advantage of such a construction is that, since the magnetic fields are substantially homogeneous near the electron beams 6 and 8, the forces exerted on the electron beams can be readily controlled and the electron beams are not distorted (or at least not to an appreciable degree) by the magnetic fields.

What is claimed is:

1. A color display device comprising a color cathode ray tube including an in-line electron gun for generating three electron beams, a color selection electrode, a display window having an inner surface which is curved in at least one direction, a phosphor screen on said inner surface, and means for deflecting the electron beams across the color selection electrode, characterized in that the color selection electrode is flat in at least said one direction, and the color display device comprises means for dynamically influencing the paths of the electron beams to increase the distance between the electron beams at the location of the deflection plane as a function of the deflection in said one direction.

2. A color display device as claimed in claim 1, characterized in that the radius of curvature along the at least one direction of the inner surface of the display window ranges between 8 and 16 times the diameter of the display window.

3. A color display window as claimed in claim 1, characterized in that said means comprises a first and a second means for influencing which are at some distance from each other.

4. A color display device as claimed in claim 3, characterized in that the first means for influencing comprises one or more components of the electron gun.

5. A color display device as claimed in claim 3, characterized in that the second means for influencing is integrated in the deflection unit of the display device.

6. A color display device as claimed in claim 1, characterized in that the inner surface of the display window is also curved in a second direction, and the display device comprises further means for dynamically influencing the paths of the electron beams so as to increase the distance between the electron beams at the location of the deflection plane as a function of deflection in the second direction.

7. A color display device as claimed in claim 6, characterized in that the radius of curvature along the one and/or the second direction of the inner surface of the display window ranges between 8 and 16 times the diameter of the display window.

8. A color display device as claimed in claim 6, characterized in that the further means comprise third and fourth means for influencing, disposed at some distance from each other.

9. A color display device as claimed in claim 8, characterized in that said means comprises a first and a second means for influencing which are at some distance from each other, and the third and fourth means for influencing are integrated in, or equivalent to, the first and second means.

10. A color display device as claimed in claim 8, characterized in that the third means for influencing comprise one or more components of the electron gun.

11. A color display device as claimed in claim 8, characterized in that said means comprises a first and a second means for influencing which are at some distance from each other, and the second and/or fourth means are integrated in the deflection unit of the display device.

12. A color display device as claimed in claim 1, characterized in that the outside surface of the display window is flat in the at least one direction.

13. A color display device as claimed in claim 12, characterized in that the inner surface of the display window is also curved in a second direction, and the display device comprises further means for dynamically influencing the paths of the electron beams so as to increase the distance between the electron beams at the location of the deflection plane as a function of deflection in the second direction.

14. A color display device as claimed in claim 13, characterized in that the radius of curvature along the one and/or the second direction of the inner surface of the display window ranges between 8 and 16 times the diameter of the display window.

15. A color display device as claimed in claim 13, characterized in that the further means comprise third and fourth means for influencing, disposed at some distance from each other.

16. A color display device as claimed in claim 13, characterized in that said means comprises a first and a second means for influencing which are at some distance from each other, and the further means comprise third and fourth means for influencing, disposed at some distance from each other.

17. A color display device as claimed in claim 16, characterized in that the third and fourth means for influencing are integrated in, or equivalent to, the first and second means.

18. A color display device as claimed in claim 16, characterized in that the first and/or third means for influencing comprise one or more components of the electron gun.

19. A color display device as claimed in claim 16, characterized in that the second and/or fourth means for influencing are integrated in the deflection unit of the display device.

* * * * *